United States Patent [19]

Yano et al.

[11] 4,150,933

[45] Apr. 24, 1979

[54] APPARATUS FOR MOLDING ROOFING PANELS HAVING A STEPPED PORTION

[75] Inventors: Naomichi Yano; Kazuhiro Shinohara; Joe Sato, all of Osaka, Japan

[73] Assignee: Kubota Ltd., Osaka, Japan

[21] Appl. No.: 874,648

[22] Filed: Feb. 2, 1978

[30] Foreign Application Priority Data

Feb. 2, 1977 [JP] Japan ..... 52-11088
Feb. 2, 1977 [JP] Japan ..... 52-11089
Feb. 2, 1977 [JP] Japan ..... 52-11090

[51] Int. Cl.[2] ..... B28B 1/29; B28B 3/00
[52] U.S. Cl. ..... 425/219; 425/412
[58] Field of Search ..... 425/218, 219

[56] References Cited

U.S. PATENT DOCUMENTS 3,148,432 9/1964 Garnett ..... 425/219 X
3,184,818 5/1965 Crile ..... 425/219 X

*Primary Examiner*—J. Howard Flint, Jr.
*Attorney, Agent, or Firm*—Armstrong, Nikaido, Marmelstein & Kubovcik

[57] ABSTRACT

An apparatus for molding roofing panels having an insert portion extending from one end of the main body of the panel and offset stepwise from the surface of the main body. The apparatus comprises a lower die divided into a die segment for forming the insert portion and a die segment for forming the main body which have cavities conforming to the shapes of the insert portion and the main body of the panel respectively, and a movable hopper disposed to the front of the insert portion die segment and adapted to feed a material in a specified thickness. The main body die segment is initially held in its raised position with the bottoms of the two die segments positioned at the same level, and the movable hopper is reciprocated to feed the material into the combined cavity of the lower die to a uniform thickness. Subsequently an upper die is lowered into the lower die cavity to press the material, with the main body die segment also lowered by the amount of the offset of the panel insert portion. The insert portion and main body of the roofing panel thus formed are substantially equal in thickness.

7 Claims, 10 Drawing Figures

APPARATUS FOR MOLDING ROOFING PANELS HAVING A STEPPED PORTION

BACKGROUND OF THE INVENTION

Cement roofing panels are usually made from a mixture of cement and sand in the ratio by weight of 1:3 by adding water to the mixture to prepare a flowable mortar, press-molding the mortar on a die board and curing the resulting moldings. However roofing panels obtained have the drawbacks of being heavy, having insufficient heat-insulating properties and being prone to cracking during curing.

The present applicant (or assignee) has previously invented lightweight roofing panels made from a mixture of cement and an inorganic foamed aggregate such as pumice, foamed siliceous sand or the like by adding a small amount of water, i.e. about 3 to 15% by weight of water based on the mixture, to wet the starting mixture, placing the mixture into molds, and pressing the mixture at a pressure of 200 to 600 kg/cm$^2$ and curing the molded pieces. Since the inorganic foamed aggregate remains porous as incorporated in the cement roofing panels obtained by the dry method, the panels have the advantages of having a reduced specific gravity, being lightweight, possessing improved heat-insulating properties and being less susceptible to cracking during curing.

This invention relates to an apparatus for molding roofing panels by the dry method described above, and more particularly to an apparatus for producing roofing panels, as shown in FIGS. 9 and 10, which include a main body 2 and an insert portion 4 extending stepwise from one end of the main body 2, the main body 2 and the insert portion 4 having substantially the same thickness.

Such roofing panels having a stepped portion are adapted for use on the ridge of roofs as arranged continuously in a row as illustrated in FIG. 10, with the insert portion 4 of each panel fitted to the other end of the adjacent panel. Roofing panels of this type are not limited to the illustrated arched panels but include those L- or V-shaped in cross section, those in the form of a flat plate, etc. The molding apparatus of this invention is useful for the production of various kinds of roofing panels having a stepped portion.

SUMMARY OF THE INVENTION

An object of this invention is to provide an apparatus for molding roofing panels having a stepped portion by the dry method, the roofing panels comprising a main body and an offset insert portion having the same thickness or desired different thicknesses.

Another object of this invention is to provide an apparatus for molding roofing panels of the type described above in which the junction between the main body and the insert portion is tapered on its inner side to reinforce the junction.

DETAILED DESCRIPTION OF THE INVENTION

Figure 9:
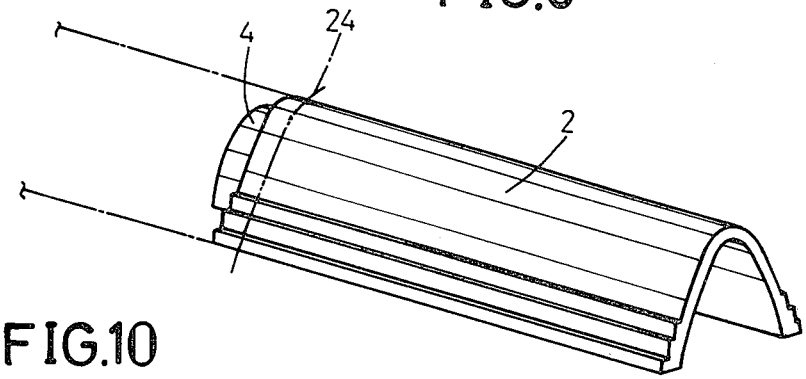
FIG. 9 is a perspective view showing a roofing panel having a stepped insert portion.
Figure 10:
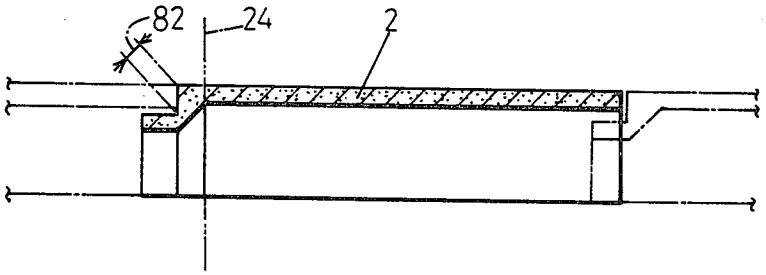
FIG. 10 is a view in vertical section taken along the center line of the panel shown in FIG. 9.

The apparatus shown is adapted to mold archlike roofing panels each including a main body 2, an insert portion 4 extending stepwise from one end of the main body 2 as seen in FIGS. 9 and 10. A lower die 8 is disposed above a machine bed 6. A top plate 12 mounted on upper portions of posts 10 is provided with a hydraulic piston-and-cylinder assembly 14 which raises and lowers an upper die 16 attached thereto.

The upper die 16 has arched molding faces 18 and 20 conforming to the curved shapes of the insert portion 4 and tne main body 2 of the panel respectively. The junction between the molding faces 18 and 20 is tapered as at 22.

Figure 1:
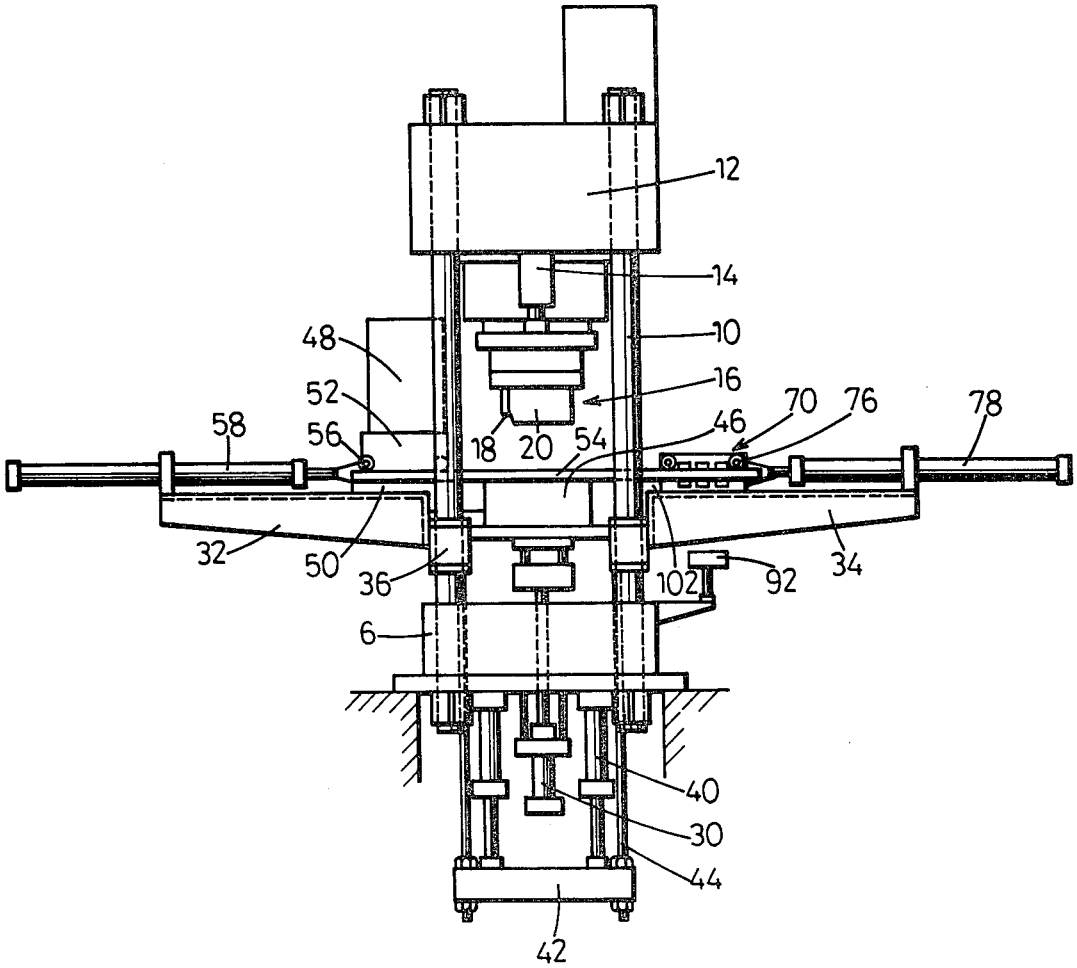
FIG. 1 is a front view showing a molding apparatus according to this invention.
Figure 2:
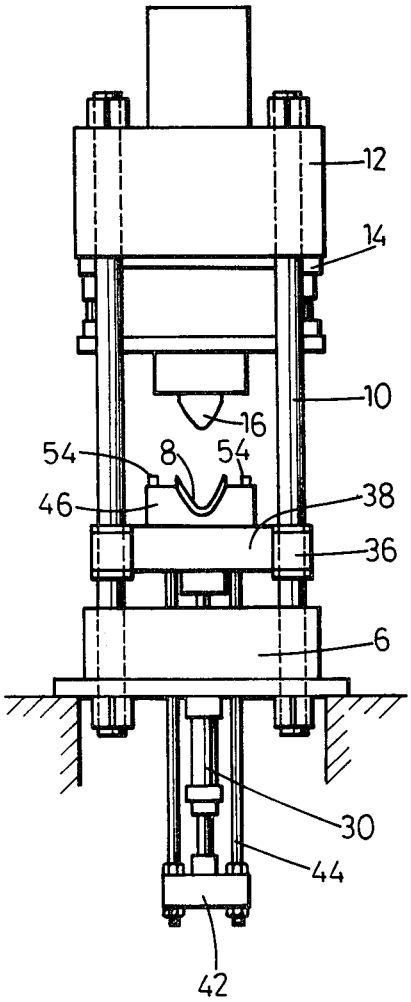
FIG. 2 is a side elevation of the same.
Figure 3:
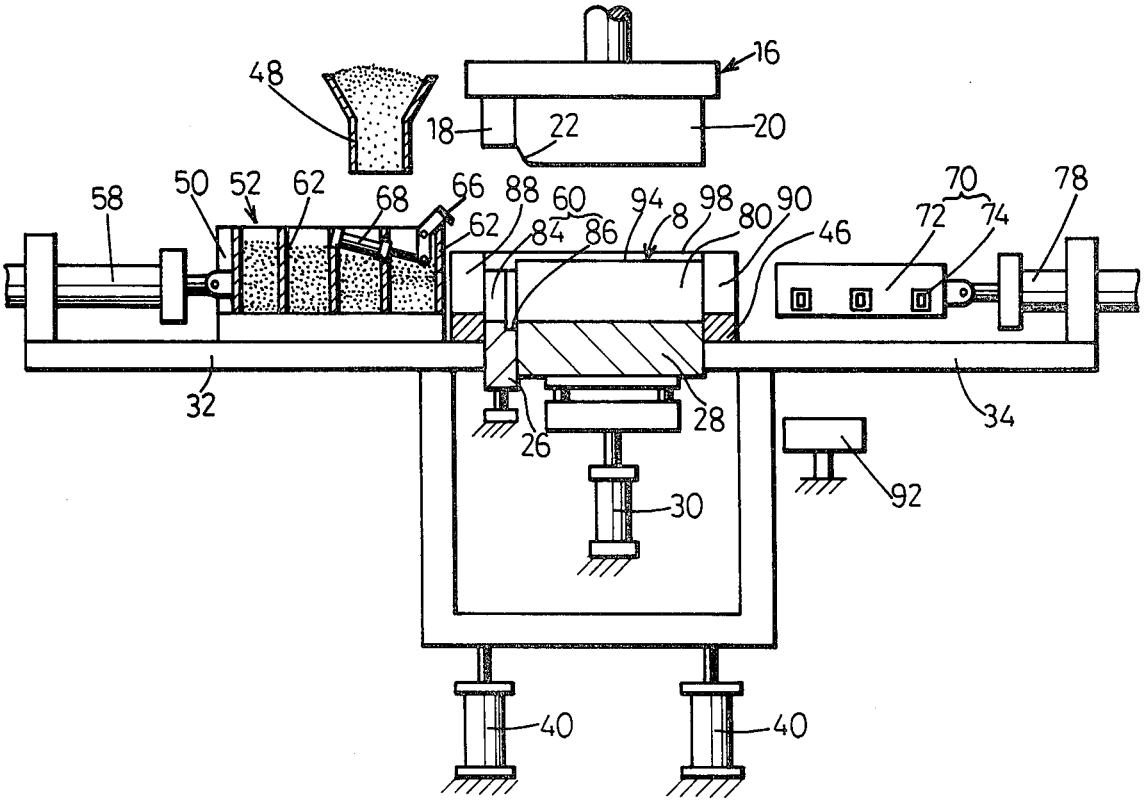
FIG. 3 is a fragmentary front view of the apparatus showing the construction of FIG. 1 as simplified for a better understanding of the apparatus.

The lower die 8 is divided, at the portion thereof corresponding to the position indicated at the two-dot-and-dash line in FIGS. 9 and 10 into two, namely as insert portion die segment 26 for molding the panel insert portion 4 and part of the panel main body 2, and a main body die segment 28 for molding the remainder of the panel main body 2. As seen in FIGS. 1 and 3, the insert portion die segment 26 is fixed to the machine bed 6. The main body die segment 28 is connected to the forward end of the piston of hydraulic means 30 supported by the machine bed 6 and is movable upward and downward.

The posts 10 slidably carry bolsters 36 provided with two brackets 32 and 34 extending rearward and forward respectively. Connecting plates 38 each interconnecting each pair of the bolsters 36 are connected by rods 44 to a connecting plate 42 on the forward ends of the pistons of hydraulic cylinders 40 supported by the machine bed 6. The hydraulic piston-and-cylinder assemblies 40, when operated, raise or lower the two brackets 32 and 34 at the same time.

A frame 46 fitting around the insert portion die segment 26 and main body die segment 28 is movable upward and downward independently of the segments 26 and 28. The frame 46 is attached to the connecting plates 38 of the bolsters 36 and is upwardly and downwardly movable with the brackets 32 and 34.

Disposed above the bracket 32 close to the insert portion die segment 26 is a feeder chute 48 for feeding the material for roofing panels. An apron 50 is positioned below and opposed to the feeder chute 48. A movable hopper 52 for carrying the material fits in the apron 50.

Two parallel rails 54 extend between and supported by brackets 32 and 34. The movable hopper 52 is provided on its opposite sides with wheels 56 supported on the rails 54. Reciprocal drive means 58, such as a hydraulic piston-and-cylinder assembly, mounted on the bracket 32 is coupled to the movable hopper 52 to reciprocally drive the hopper 52 between the feeder chute 48 and the lower die 8.

Figure 4:
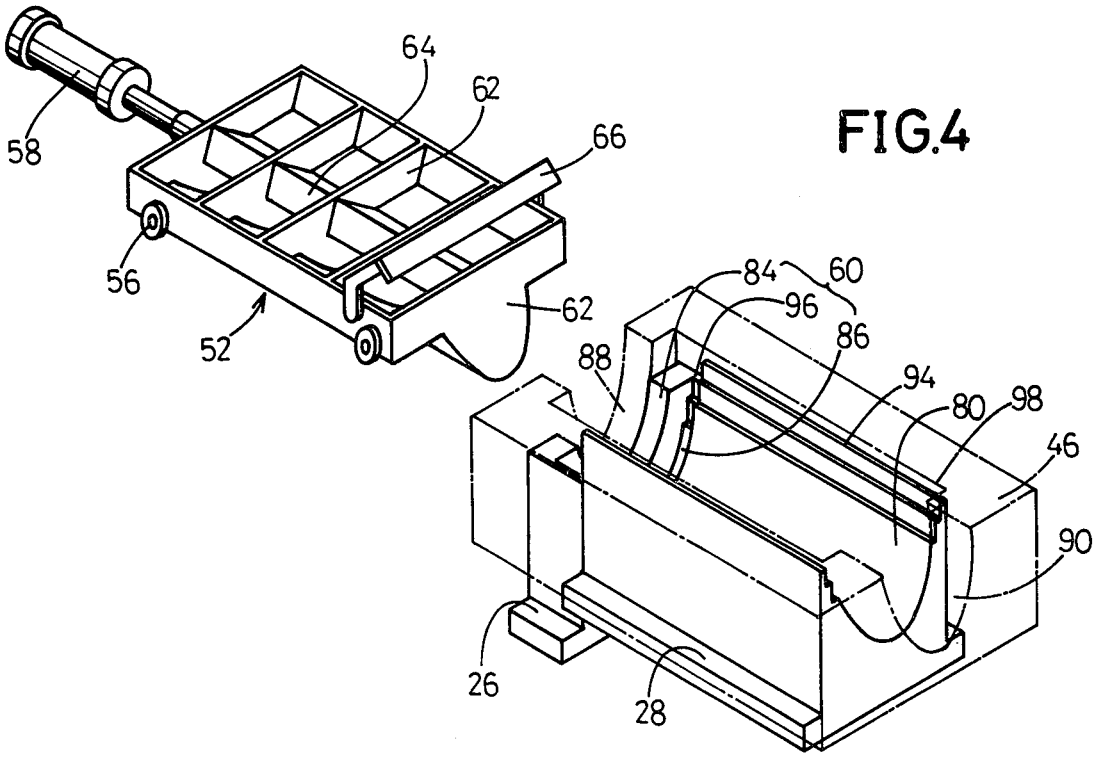
FIG. 4 is a perspective view showing a lower die and a movable hopper.

As shown in FIGS. 3 and 4, the movable hopper 52 comprises a rectangular frame open at its top and bottom and scrapers 62 disposed in its interior and at the front and rear ends thereof. The scrapers 62 conform to the cross sectional form of the cavity 60 of the insert die segment 26 but are smaller than the cross sectional size of the cavity 60 by the thickness of the material to be accumulated therein. The hopper 52 has a longitudinal dividing plate 64 extending centrally thereof and is provided at its front end with an upwardly and downwardly movable scraping plate 66 for scraping off an excess of the material. Drive means 68, such as an electromagnet, coupled to the scraping plate 66 lowers the scraping plate 66 at a suitable time.

The other bracket 34 carries thereon reciprocally movable means 70 for withdrawing molded panels. The withdrawing means 70 comprises a hollow vacuum box 72 having contours conforming to the inside shape of molded roofing panels and formed in its opposite sides with suction apertures 74. The aperture is surrounded by a pad. The box 72 is provided on its opposite sides with wheels 76 supported on the rails 54 and is coupled to drive means 78, such as a hydraulic piston-and-cylinder assembly, which reciprocally drives the box 72 between the lower die 8 and the bracket 34.

Figure 5:
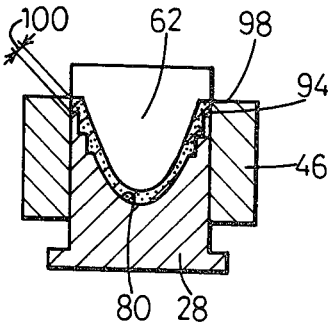
FIG. 5 is a view in section taken along the line V–V in FIG. 6.

As shown in FIGS. 4 and 5, the lower die 8 has vertical sides fitting in the vertically movable frame 46 and cavities conforming to the outside contours of the roofing panel to be formed. More specifically, the insert portion die segment 26 is provided with a cavity 84 conforming to the shape of the panel insert portion 4 for forming the insert portion and with a short cavity 86 conforming to the shape of the panel main body 2 for forming part of the main body 2, the cavity 86 being positioned at one end of the insert portion forming cavity 84. The main body die segment 28 is formed with a cavity 80 conforming to the shape of the panel main body 2.

The frame 46 is formed in its front and rear end walls with cutouts 88 and 90 conforming to the shape of the scrapters 62 on the movable hopper 52. The hopper 52 is movable over the lower die 8 and the frame 46.

OPERATION

When the material is fed to the lower die 8, the main body die segment 28 is held in its raised position, and the bottom of the segment 28 defining the cavity 80 is positioned at the same level as the bottom of the insert portion die segment 26 defining the cavity 84. Accordingly the upper edges 94 of the main body cavity 28 are positioned at a level which is higher by the amount of offset 82 of the insert portion 4 than the upper edges 96 of the insert portion die segment 26. With the frame 46 also in its raised position, the bottom surfaces of the frame 46 defining the cutouts 88, 90 and the upper edges 98 of the frame 46 are positioned at levels which are higher by the thickness 100 of the layer of the material to be accumulated in the die 8 than the upper edges 94 of the main body die segment 28.

The feeder chute 48 feeds the material into the movable hopper 52 which is located immediately below the chute, namely into the spaces defined by the apron 50 and the scrapers 62. The material is a powdery to granular mixture of cement and pumice, foamed siliceous sand or like inorganic foamed aggregate and is wetted with 3 to 15% by weight of water based on the mixture.

Figure 6:
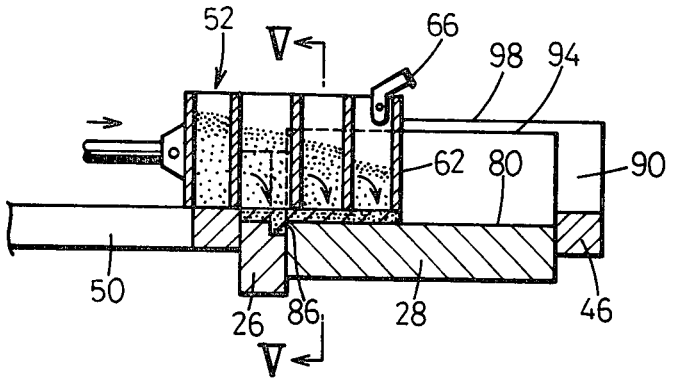
FIGS. 6 to 8 are views illustrating the movement of the lower die, the movable hopper, an upper die and a frame in the course of molding operation.

Subsequently the drive means 58 advances the movable hopper 52 over the cutout 88 of the frame 46 as shown in FIG. 6, with the scraping plate 66 in its raised position, feeding the material from the spaces between the scrapers 62 into the cavities 60 and 80 of the lower die 8. Since the movable hopper 52 travels as supported on the rails 54, the lower ends of the scrapers 62 come into contact with the bottom face of the frame 46 defining the cutout 88 and are maintained at a constant distance above the bottom faces of the die segments 26, 28 defining the cavities 60, 80. The material is therefore accumulated in the cavity 80 as well as on the upper edges 94, 96 to a predetermined thickness. The hopper 52 passes over the lower die 8 and advances to the other cutout 90 of the frame 46 or further to an apron 102 in front of the frame 46, thus feeding the material into the die cavities 60 and 80. The drive means 58 thereafter retracts the movable hopper 52.

Figure 7:
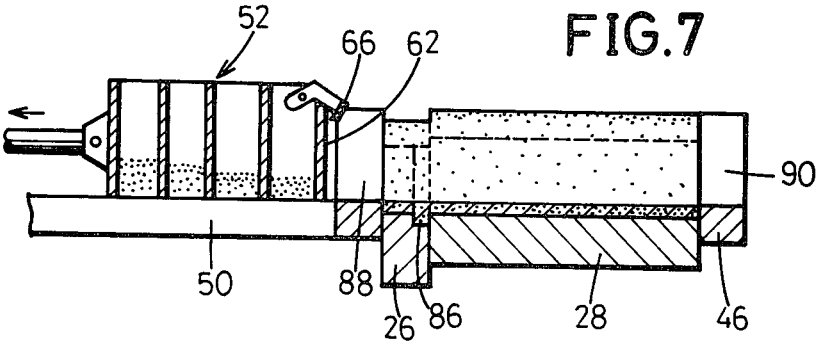

With the backward travel of the hopper 52, the scrapers 62 scrape off an excess of the material fed to the die cavities of the lower die 8, thus leaving a layer of the material in the die cavities 60, 80 and over the upper edges 94, 96 in a thickness (25 to 35 mm) equal to the clearance between the outer periphery of the scrapers 62 and the bottom surfaces defining the cavities 60, 80. When the front end of the hopper 52 retracts to the location of the insert portion die segment 26 after passing over the main body die segment 28, an unillustrated sensor actuates the drive means for the scraping plate 66 to lower the plate 66, causing the plate 66 to scrape off the material from the upper edges 96 of the insert die segment 26 by an amount corresponding to the amount of the offset 82 of the insert portion 4 as shown in FIG. 7. As a result, the same thickness of material is left accumulated on the upper edges 96, 94 of the two die segments 26, 28.

Upon retraction of the movable hopper 52 to the position immediately below the feeder chute 48, the hopper 52 is retained in this position for the next feeding operation with the scraping plate 66 returned to its raised position.

Figure 8:
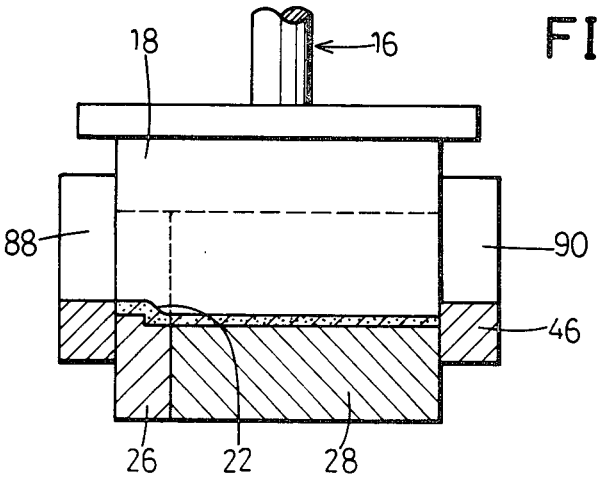

The upper die 16 is lowered into the lower die 8 and compresses the material placed in the cavities 60 and 80. Almost simultaneously with the downward stroke of the upper die 16, the hydraulic piston-and-cylinder assembly 30 supporting the main body die segment 28 operates, lowering the segment 28 by the amount of offset 82 of the panel insert portion 4, with the result that the upper edges 94 and the bottom face of the segment 28 defining the cavity 80 become flush with the upper edges 96 of the insert portion die segment 26 and the bottom face thereof defining the main body forming cavity 86 at its one end. Consequently the material filling the cavity 86 partially flows into the cavity 80 of the die segment 28, and a slanting accumulation of the material is formed in the main body forming cavity 86. (see FIG. 8.)

The upper die 16 compresses the accumulation of the material in the two die cavities 60 and 80 at high pressure of 200 to 600 kg/cm$^2$ for several seconds to such an extent that the foamed aggregate contained in the material will not lose its porosity.

The hydraulic piston-and-cylinder assemblies 40 supporting the frame 46 thereafter operate, lowering the frame 46 to a position slightly lower than the upper edges 94 and 96 of the lower die 8. The upper die 16 is then raised to its original position, whereupon the molding formed by compression spontaneously releases itself from the die segments 26 and 28 by virtue of the expansion of the pores in the material.

After the rise of the upper die 16, the drive means 78 on the bracket 34 operates, driving the vacuum box 72 to a position above the molded panel in the lower die 8 to bring the box 72 into fitting engagement with the curved surface of the panel. The box 72 exerts suction on the panel, which in turn comes into intimate contact with the pads surrounding the suction apertures 72. The drive means 78 then retracts the vacuum box 72 with the molded panel intimately fitting thereto and withdraws the panel from the lower die 8. The pistons of the hydraulic assemblies 40 descend again, lowering the brackets 32 and 34 to position the molded panel above a table 92, whereupon the vacuum box 72 discontinues its vacuum action and places the molded panel on the table 92. The parts are then raised to the original position.

With the use of the apparatus of this invention, roofing panels having a stepped portion can be molded from a mixture of cement and an inorganic foamed aggregate by the dry method. The material is fed to the lower die with the main body die segment 28 positioned at a level higher than the insert portion die segment 26 by the amount of the offset of the panel insert portion 26, and the material is compressed with the main body die segment 28 thereafter brought to its lowered position, so that the material can be accumulated in the insert portion forming cavity 60 and the main body forming cavity 80 to the same thickness, or to different thicknesses if the raised position of the main body die segment 28 is altered. Roofing panels having a variety of stepped portions are moldable, therefore.

The present apparatus has another feature that the main body forming cavity 86, which is formed in the insert portion die segment 26 with a greater depth than the insert portion forming cavity 84, serves to give an increased thickness to the stepped portion of the panel which tends to have reduced strength, consequently imparting greater strength to the panel.

We claim:

1. In an apparatus for molding roofing panels having a stepped portion by placing a roofing panel material into the cavity of a lower die and lowering an upper die into the lower die to compress the material, the improvement comprising:

a lower die having cavities conforming to the outside contours of the roofing panel including a main body and an offset insert portion, the lower die being divided into a die segment for forming the main body and a die segment for forming the insert portion at a portion of the cavity for forming the insert portion, drive means for supporting the main body die segment to raise and lower the main body die segment, a horizontally supported hopper movable into and out of the lower die cavity and provided at its front end with a scraper smaller than the cross section of the cavity of the insert portion die segment by the thickness of the material to be accumulated therein, and an upper die vertically movably disposed above the lower die and having a molding face conforming to the shape of the inside face of the roofing panel.

2. An apparatus as defined in claim 1 wherein the insert portion die segment is formed at an end of the insert portion forming cavity with part of the main body forming cavity, the upper die molding face being partially tapered in corresponding relation to the offset of the insert portion.

3. An apparatus as defined in claim 1 wherein the insert portion forming cavity and the main body forming cavity are each defined by an arched bottom face of the die segment.

4. An apparatus as defined in claim 1 wherein the drive means raises and lowers the main body die segment by an amount corresponding to the offset of the insert portion.

5. In an apparatus for molding roofing panels having a stepped portion by placing a roofing panel material into the cavity of a lower die and lowering an upper die into the lower die to compress the material, the improvement comprising:

a lower die having cavities conforming to the outside contours of the roofing panel including a main body and an offset insert portion, the lower die being divided into a die segment for forming the main body and a die segment for forming the insert portion at a portion of the cavity for forming the insert portion, drive means for supporting the main body die segment to raise and lower the main body die segment, a horizontally supported hopper movable into and out of the lower die cavity and provided at its front end with a scraper smaller than the cross section of the cavity portion of the insert portion die segment by the thickness of the material to be accumulated therein, a frame upwardly and downwardly movably fitting around the insert portion die segment and the main body die segment and formed in each of its front and rear wall with a cutout conforming to the shape of the scraper on the movable hopper, drive means for supporting the frame to raise and lower the frame, and an upper die vertically movably disposed above the lower die and having a molding face conforming to the shape of the inside face of the roofing panel.

6. An apparatus as defined in claim 5 wherein the insert portion die segment is formed at an end of the insert portion forming cavity with part of the main body forming cavity, the main body die segment being upwardly and downwardly movable by an amount corresponding to the offset of the insert portion, the upper die molding face being partially tapered in corresponding relation to the offset of the insert portion.

7. An apparatus as defined in claim 6 wherein the scraper scrapes off accumulations of the material from the upper edges of the insert portion die segment by an amount corresponding to the vertical stroke of the main body die segment, the movable hopper being provided with drive means for holding the scraper in its raised position and lowering the scraper when the scraper has passed over the main body die segment during retraction of the movable hopper.

* * * * *